US010619538B2

(12) United States Patent
Matsumoto

(10) Patent No.: US 10,619,538 B2
(45) Date of Patent: Apr. 14, 2020

(54) EXHAUST DEVICE OF ENGINE

(71) Applicant: SUZUKI MOTOR CORPORATION, Hamamatsu-shi, Shizuoka (JP)

(72) Inventor: Akio Matsumoto, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 47 days.

(21) Appl. No.: 15/846,695

(22) Filed: Dec. 19, 2017

(65) Prior Publication Data

US 2018/0202335 A1 Jul. 19, 2018

(30) Foreign Application Priority Data

Jan. 16, 2017 (JP) ..... 2017-004815
Jul. 5, 2017 (JP) ..... 2017-131610

(51) Int. Cl.
*F01N 1/08* (2006.01)
*F01N 3/10* (2006.01)
*F01N 13/08* (2010.01)

(52) U.S. Cl.
CPC ..... *F01N 1/083* (2013.01); *F01N 1/084* (2013.01); *F01N 1/089* (2013.01); *F01N 3/10* (2013.01); *F01N 13/082* (2013.01); *F01N 2470/18* (2013.01); *F01N 2490/02* (2013.01); *F01N 2590/04* (2013.01)

(58) Field of Classification Search
CPC ..... F01N 1/083; F01N 1/084; F01N 1/089; F01N 13/082; F01N 3/10; F01N 3/2885; F01N 2470/18; F01N 2490/02; F01N 2590/04
USPC ..... 60/299
See application file for complete search history.

(56) References Cited

U.S. PATENT DOCUMENTS 6,250,075 B1 * 6/2001 Funakoshi ..... F01N 1/089 60/299
8,985,271 B1 * 3/2015 Yoshida ..... F01N 3/2885 181/269
10,196,947 B2 * 2/2019 Leroy ..... F01N 1/083
2006/0101813 A1 * 5/2006 Wu ..... F01N 3/2885 60/299

FOREIGN PATENT DOCUMENTS

EP 3 064 722 A1 1/2016
JP 2016-160915 A 9/2016

* cited by examiner

*Primary Examiner* — Patrick D Maines
*Assistant Examiner* — Dapinder Singh
(74) *Attorney, Agent, or Firm* — Stein IP, LLC

(57) ABSTRACT

An engine exhaust device includes an exhaust pipe attached to a vehicle engine and a silencer connected to a downstream side of the exhaust pipe; the silencer includes a first partition wall which partitions an internal space of the silencer into at least two spaces in a first direction and a second partition wall which partitions one of the at least two spaces into two spaces in a second direction that crosses the first direction; another one of the at least two spaces is larger in capacity than each of the two spaces defined by the second partition wall; and a downstream end of the exhaust pipe is open in the another one of the at least two spaces.

2 Claims, 5 Drawing Sheets

EXHAUST DEVICE OF ENGINE

CROSS-REFERENCE TO RELATED APPLICATIONS

This application claims the benefit of Japanese Patent Application JP 2017-004815 filed on Jan. 16, 2017, and Japanese Patent Application JP 2017-131610 filed on Jul. 5, 2017, the entire contents of which are hereby incorporated by reference, the same as if set forth at length.

FIELD OF THE INVENTION

The present invention relates to an exhaust device of an engine.

BACKGROUND OF THE INVENTION

Among engine exhaust devices that are applied to vehicles are ones that are equipped with a silencer (refer to JP-A-2016-160915, for example). In the engine exhaust device disclosed in JP-A-2016-160915, an exhaust pipe extends downward from the front surface of a cylinder head and a silencer is connected to a downstream side of the exhaust pipe. The silencer is shaped like a box having a prescribed capacity, and its internal space is divided by plural partition walls (separators). The plural divisional spaces constitute respective expansion chambers where to expand exhaust gas.

SUMMARY OF THE INVENTION

In the engine exhaust device disclosed in JP-A-2016-160915, the expansion chambers are formed by the plural partition walls so as to be arranged in the front-rear direction. In this case, the front-rear lengths of the respective expansion chambers are small, that is, the intervals between the partition walls are small, which means that the degree of freedom of layout of the expansion chambers is low. This may raise a problem that exhaust gas does not expand sufficiently in the expansion chambers and hence the silencing effect is made low.

The present invention has been made in view the above problem, and an object of the invention is therefore to provide an engine exhaust device capable of enhancing the silencing effect while increasing the degree of freedom of layout of expansion chambers and that of arrangement of components in a silencer.

An engine exhaust device according to an aspect of the invention includes an exhaust pipe attached to a vehicle engine and a silencer connected to a downstream side of the exhaust pipe, wherein: the silencer comprises: a first partition wall which partitions an internal space of the silencer into at least two spaces in a first direction; and a second partition wall which partitions one of the at least two spaces into two spaces in a second direction that crosses the first direction; another one of the at least two spaces is larger in capacity than each of the two spaces defined by the second partition wall; and a downstream end of the exhaust pipe is open in the another one of the at least two spaces.

The invention makes it possible to enhance the silencing effect while increasing the degree of freedom of layout of expansion chambers and that of arrangement of components in a silencer.

DESCRIPTION OF SYMBOLS

Figure 1:
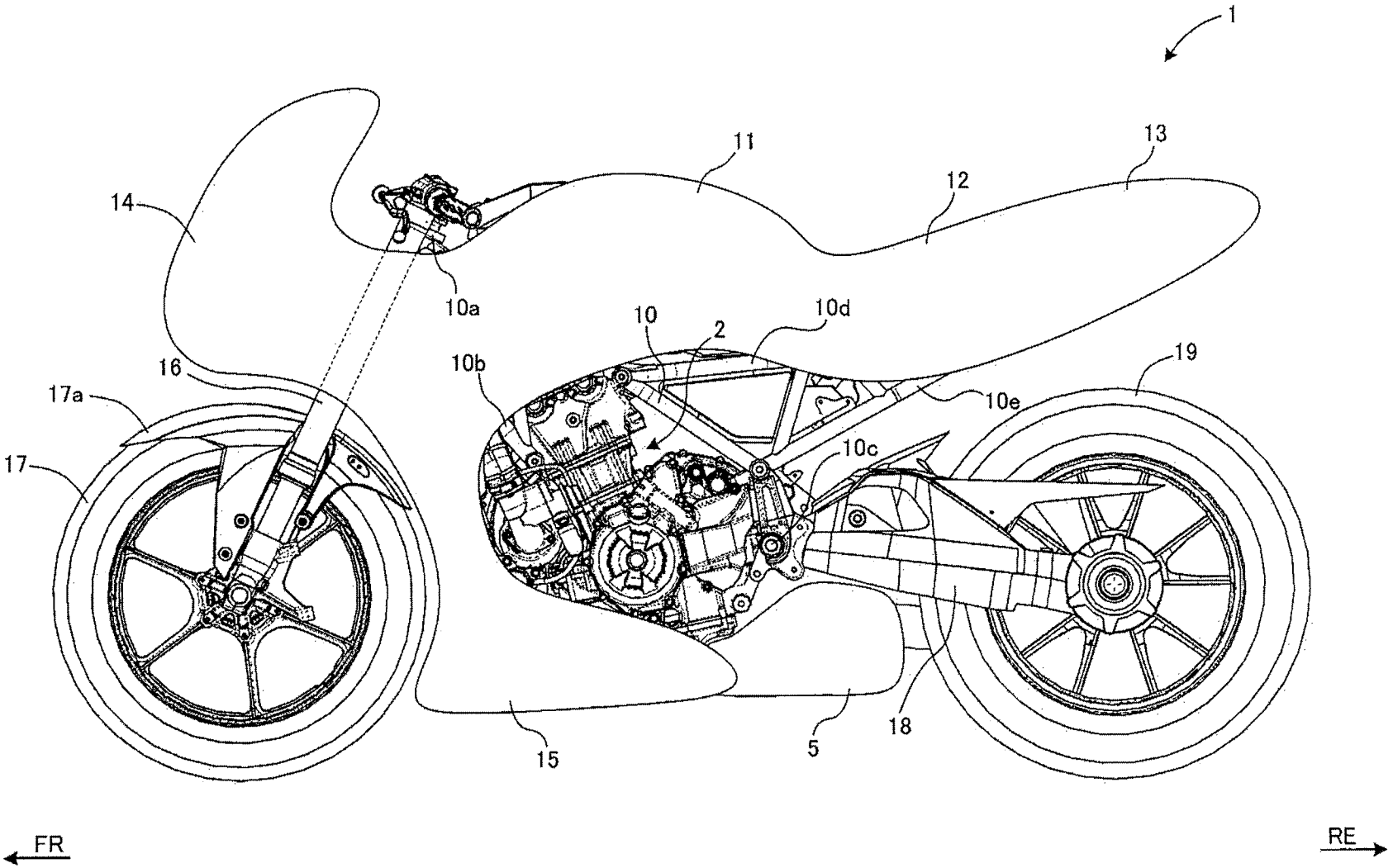
FIG. 1 is a left side view outlining the configuration of a motorcycle according to an embodiment of the present invention.

1: Motorcycle
2: Engine
4: Exhaust pipe
5, 7, 8: Silencer
50, 70, 80: Baffle plate
51, 71, 81: First baffle plate (first partition wall)
51*a*, 71*a*, 81*a*, 82*a*: Communication pipe (communication portion)
52, 72, 82: Second baffle plate (second partition wall)
52*a*, 72*a*: Communication hole
55, 75, 85: Tail pipe
6: Catalyst unit
74, 84: Baffle pipe
S1: Expansion chamber (another space)
S2, S3: Expansion chamber (one space)

DETAILED DESCRIPTION OF THE INVENTION

An embodiment of the present invention will be hereinafter described in detail with reference to the accompanying drawings. Although the following description will be directed to a case that the engine exhaust device according to the invention is applied to a sport motorcycle, it can also be applied to other things. For example, the engine exhaust device according to the invention may be applied to other types of motorcycles, buggy-type motor tricycles, automobiles, etc. The forward, backward, leftward, and rightward directions with respect to the vehicle will be indicated by arrows FR, RE, L, and R, respectively. In each of the drawings, some components are omitted for convenience of description.

Figure 2:
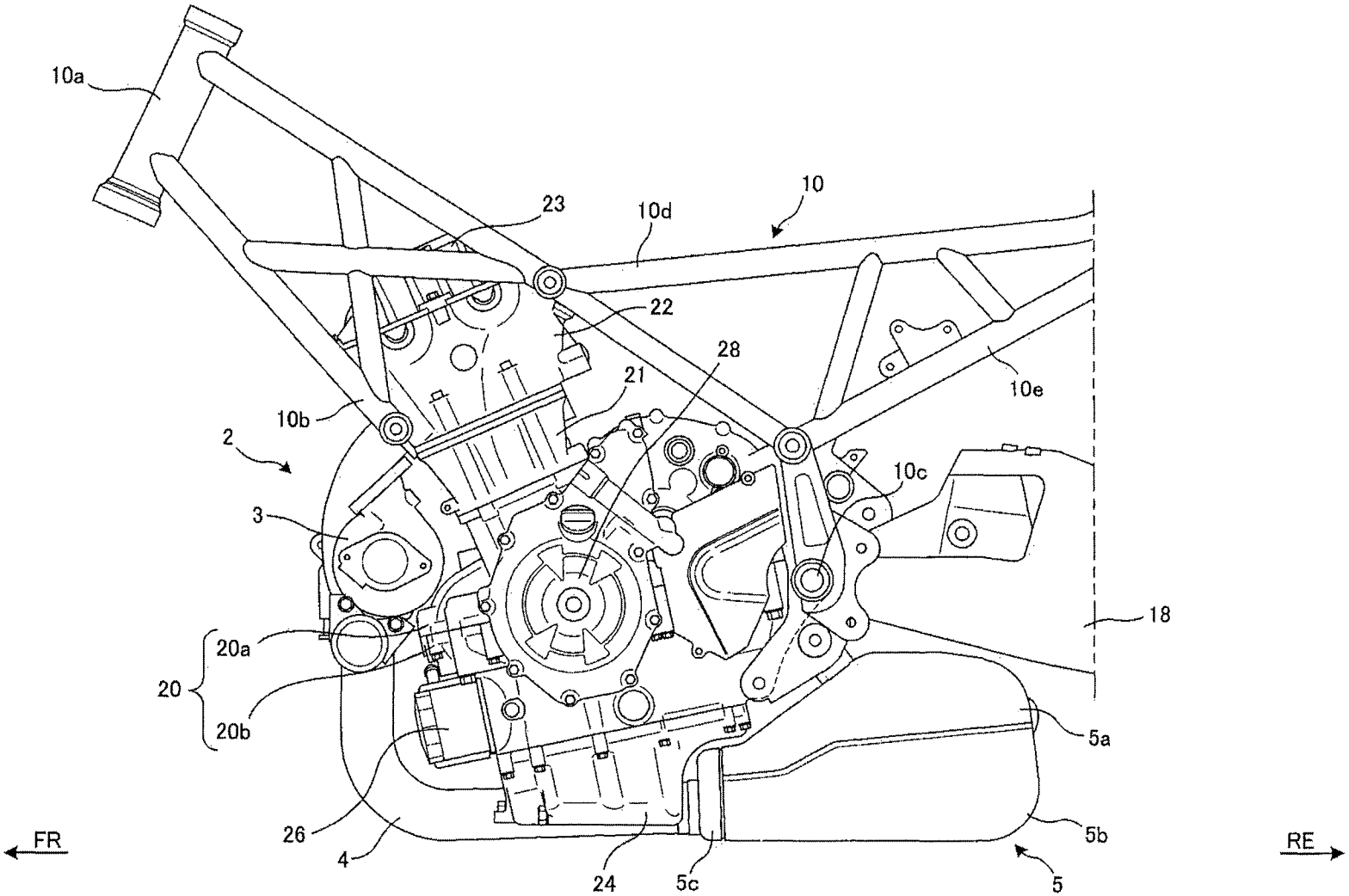
FIG. 2 is a left side view showing the arrangement of an engine and components around it that are employed in the embodiment.

First, the configuration of a motorcycle 1 according to the embodiment will be outlined with reference to FIGS. 1 and 2. FIG. 1 is a left side view outlining the configuration of the motorcycle 1 according to the embodiment. FIG. 2 is a left side view showing the arrangement of an engine 2 and components around it that are employed in the embodiment.

As shown in FIGS. 1 and 2, the motorcycle 1 is configured in such a manner that the engine 2 is suspended from a vehicle body frame 10 which is mounted with various components such as a power unit and electric components. For example, the engine 2 is a parallel two-cylinder, water-cooled engine. The engine 2 is configured in such a manner that an assembly of a cylinder block 21, a cylinder head 22, and a cylinder head cover 23 is attached to a top portion of a crank case 20 which houses, among other things, a crank shaft (not shown) extending in the left-right direction. An oil pan 24 is disposed below the crank case 20.

In the embodiment, the crank case 20, the cylinder block 21, the cylinder head 22, the cylinder head cover 23, and the oil pan 24 are together called an engine case. As shown in FIG. 2, the crank case 20, which is part of the engine case, is configured so as to be dividable in the top-bottom direction and has an upper case 20*a* and a lower case 20*b*. By combining the upper case 20*a* and the lower case 20*b* together to form the crank case 20, a space for housing various shafts is formed in the crank case 20. In particular, the external shape of a bottom-rear portion of the engine case (oil pan 24 and lower case 20*b*) has such an inclined side profile as to go up as the position goes rearward.

An oil filter 26 for filtering oil used in the engine 2 is attached to a front portion of the lower case 20*b*. A magneto cover 28 which covers a magneto (not shown) is attached, as an engine cover, to a left portion of the crank case 20.

The vehicle body frame 10 is a diamond-shaped frame that is formed by, for example, welding metal pipes together, and is configured so that the vehicle body is given, as a whole, necessary stiffness when the engine 2 is suspended from it as described above. The vehicle body frame 10 extends down rearward from a head pipe 10*a*. The vehicle body frame 10 has, as its front half, a bracket portion 10*b* which supports a front portion (cylinder head 22) of the engine 2. And the vehicle body frame 10 has, as its rear portion, a pivot portion 10*c* having a swing shaft for a swing arm 18.

The vehicle body frame 10 has, approximately at the center in the front-rear direction, a seat rail 10*d* which extends rearward. The vehicle body frame 10 has, above the pivot portion 10*c*, a back stay 10*e* which extends up rearward. A fuel tank 11 is disposed over the vehicle body frame 10, and a rider seat 12 and a pillion seat 13 are provided in the rear of the fuel tank 11 along the seat rail 10*d*. The head pipe 10*a* is covered with a front cowl 14 and a bottom-front portion of the engine 2 is covered with an under cowl 15.

To enable steering, a pair of (left and right) front fork members 16 are supported by the head pipe 10*a* via a steering shaft (not shown). A front wheel 17 is supported rotatably by bottom portions of the front fork members 16, and is covered with a front fender 17*a* from above.

The swing arm 18 is supported swingably by the pivot portion 10*c* and extends rearward. A rear wheel 19 is supported rotatably by a rear end portion of the swing arm 18.

An exhaust pipe 4 is attached to an exhaust port of the engine 2 via a turbocharger 3. The exhaust pipe 4 extends downward from a front portion of the engine 2, is then bent rearward at a position on the front-right of the oil pan 24, and then extends rearward parallel with the right side surface of the oil pan 24. The silencer 5 (also called a chamber or a muffler) is connected to a downstream end portion of the exhaust pipe 4. In the embodiment, the turbocharger 3 may be omitted.

As described later in detail, a catalyst unit 6 (see FIG. 3) for cleaning exhaust gas of the engine 2 is disposed downstream of the exhaust pipe 4. The catalyst unit 6 is housed in the silencer 5. The catalyst is a three-way catalyst, for example, and converts pollutants (carbon monoxide, hydrocarbons, nitrogen oxides, etc.) in exhaust gas into harmless substances (carbon dioxide, water, nitrogen, etc.). Exhaust gas produced by combustion of the engine 2 flows through the exhaust pipe 4 to the catalyst unit 6, where it is cleaned. The exhaust gas is lowered in the level of exhaust sound in passing through the silencer 5 and then discharged to the outside.

Incidentally, silencers that are installed in motorcycles as part of an engine exhaust device are classified into a type that is shaped like a long pipe (e.g., cylinder) and a type that is shaped like a box (e.g., cuboid box). Among such silencers are ones whose internal space is divided by plural partition walls. The divisional spaces communicate with each other by communication holes or communication pipes. Exhaust gas discharged from the engine flows into the spaces of the silencer via the exhaust pipe and expands in the spaces, whereby the level of the exhaust sound is lowered.

Since the exhaust gas silencing effect depends on the capacity and shape of the silencer, the structure of the partition walls is an important factor in designing the silencer. For example, in a silencer that is shaped like a pipe extending in the front-rear direction, one option is to divide its internal space so that plural spaces are arranged in the extension direction of the silencer (i.e., in the front-rear direction).

On the other hand, in box-shaped silencers, if a partition wall structure were employed that is similar to the above-described partition wall structure of cylindrical silencers, a problem would arise that the front-rear length of each space is made small and the degree of freedom of layout of expansion chambers is lowered. Furthermore, the reduction in the intervals between the partition walls might affect the layout, the ease of attachment, and the ease of welding of peripheral components. Still further, a communication hole or a communication pipe might be formed through a partition wall at such a position as to be close to another, adjacent partition wall, resulting in a problem that exhaust gas hits the other partition wall directly and vibrates it.

Figure 3:
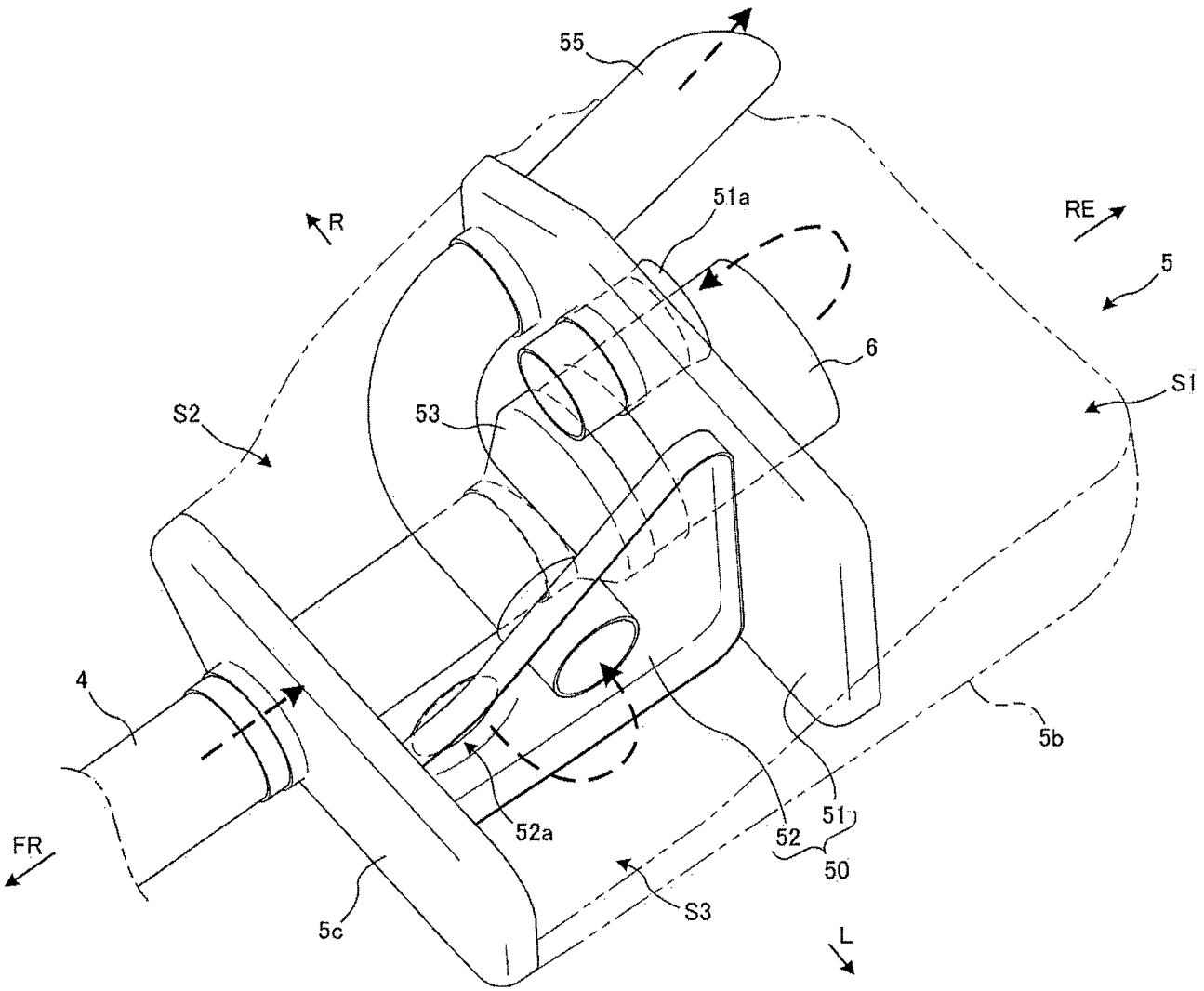
FIG. 3 is a perspective of a silencer according to the embodiment.

In view of the above, the present inventor conceived an engine exhaust device having a box-shaped silencer that can be enhanced in the silencing effect while necessary capacities of expansion chambers are secured. More specifically, the embodiment employs a structure that the internal space of the silencer 5 which is connected to a downstream side of the exhaust pipe 4 is divided into three spaces (expansion chambers S1-S3 (described later) by a T-shaped baffle plate 50 (see FIG. 3). As shown in FIG. 3, the baffle plate 50 is composed of a first baffle plate 51 (first partition wall) which partitions the internal space of the silencer 5 into two spaces in a first direction (front-rear direction) and a second baffle plate 52 (second partition wall) which partitions one of the two divisional spaces formed by the first baffle plate 51 into two spaces in a second direction (left-right direction) that crosses the first direction.

Since the internal space of the silencer 5 is divided in the front-rear direction and the left-right direction into three expansion chambers S1-S3, this structure can prevent each expansion chamber from being shortened in the longitudinal direction (front-rear direction) unlike in the case that the internal space of the silencer 5 is divided into three expansion chambers simply in one direction (front-rear direction). Each of the expansion chambers S1-S3 can be given a shape that is close to a cube.

The silencing effect of a silencer depends on the surface area of the three-dimensional shape of the expansion chamber; for example, the silencing effect is higher when the relative surface area (i.e., the ratio of the surface area of the three-dimensional shape to its volume (capacity)) is smaller. Where three expansion chambers are arranged in one direction (longitudinal direction), each expansion chamber assumes a cuboid shape having a rectangular cross section whose sides extending in the one direction is much shorter than the other sides extending in the other direction. In contrast, in the embodiment, since the internal space of the silencer 5 is divided into the three expansion chambers S1-S3 by the T-shaped baffle plate 50, each of the expansion chambers S1-S3 is given a shape that is close to a cube rather than a cuboid having a rectangular cross section whose sides extending in the one direction is much shorter than the other sides extending in the other direction.

In general, the surface area of a three-dimensional shape decreases as it comes closer to the sphere when its volume is kept constant; the cube is smaller in surface area than a cuboid having rectangular surfaces. Thus, by making each expansion chamber relatively close to a cube, its surface area can be reduced and it becomes possible to enhance the silencing effect while increasing the degree of freedom of layout of expansion chambers and that of arrangement of components in the silencer 5.

Although the details will be described later, the other space (expansion chamber S1) defined by the first baffle plate 51 is larger in capacity than each of the spaces (expansion chambers S2 and S3) defined by the second baffle plate 52 and the downstream end of the exhaust pipe 4 is open in the expansion chamber S1. This allows exhaust gas discharged from the engine 2 to be freed (expanded) first in the expansion chamber S1 having a largest capacity. As a result, the energy of exhaust gas can be attenuated to a large extent in the expansion chamber S1 to enhance the silencing effect further. Furthermore, sufficient distances can be secured between the open end of the exhaust pipe 4 and the partition walls (baffle plate 50), whereby vibration of the partition walls caused by exhaust gas can be suppressed.

Next, the silencer 5 according to the embodiment will be described in detail with reference to FIGS. 2 and 3. FIG. 3 is a perspective view of the silencer 5 according to the embodiment. In FIG. 3, how exhaust gas flows is indicated by broken-line arrows.

As shown in FIG. 2 which is a side view, the silencer 5 is disposed in the rear of the oil pad 24 and below the swing arm 18 and connected to a downstream end portion of the exhaust pipe 4. As shown in FIG. 3, the exhaust pipe 4 is disposed so as to deviate rightward from the center plane, in the left-right direction, of the silencer 5 which is shaped like a box.

The silencer 5 is formed into a box shape by welding together an upper half portion 5*a* which is open at the bottom, a lower half portion 5*b* which is open at the top, and a front wall portion 5*c* which covers front end portions of the upper half portion 5*a* and the lower half portion 5*b*. The exhaust pipe 4 is attached to the silencer 5 so as to penetrate through the front wall portion 5*c*.

In a side view, a front half portion of the silencer 5 is approximately shaped like a triangle whose height increases as the position goes rearward and its rear half portion is shaped like a rectangle. As for the front half portion of the silencer 5, the height of an upstream portion is a little larger than the outer diameter of the exhaust pipe 4 and the outer surface (top surface) that corresponds to the hypotenuse of the approximately triangular shape in a side view is inclined so as to extend up rearward. The bottom surface of the lower half portion 5*b* of the silencer 5 extends horizontally rearward. A rear half portion of the silencer 5 is continuous with its front half portion and extends horizontally rearward.

The internal space of the silencer 5 is divided into plural expansion chambers by the baffle plate 50. The baffle plate 50 has the first baffle plate 51 that partitions the internal space of the silencer 5 into a front half portion and a rear half portion and the second baffle plate 52 that partitions the front half portion into two portions in the left-right direction. The first baffle plate 51 is a flat, vertical partition wall that is located in the vicinity of the boundary between the front half portion and the rear half portion of the silencer 5, that is, located at a position that is a little in the rear of the center of the silencer 5 in the front-rear direction. The second baffle plate 52 is a vertical partition wall that extends forward from the front wall surface of the first baffle plate 51, and is approximately shaped like a triangle in a side view. The second baffle plate 52 is a little deviated leftward from the center plane, in the left-right direction, of the silencer 5.

As described above, the internal space of the silencer 5 is partitioned into the three expansion chambers S1, S2, and S3 by the baffle plate 50. The expansion chamber S1 is the internal space of the rear half portion of the silencer 5, the expansion chamber S2 is the internal space of a right-hand portion of the front half portion of the silencer 5, and the expansion chamber S3 is the internal space of a left-hand portion of the front half portion of the silencer 5. The expansion chambers S1, S2, and S3 are formed so as to decrease in capacity in this order.

A communication pipe 51*a*, which is a communication portion for allowing the expansion chambers S1 and S2 to communicate with each other, is attached to the first baffle plate 51 at a position that is a little deviated up leftward from the center of the first baffle plate 51. The communication pipe 51*a* is shaped like a cylinder, and extends in the front-rear direction penetrating through the first baffle plate 51 in its thickness direction. A communication hole 52*a*, which is a communication portion for allowing the expansion chambers S2 and S3 to communicate with each other, penetrates through the second baffle plate 52 in its thickness direction at a position close to its top-front corner. The communication hole 52*a* is formed at such a position as to overlap with the exhaust pipe 4 in a side view.

As described above, the exhaust pipe 4 penetrates through a right half portion of the front wall portion 5*c* and an upstream end portion of the catalyst unit 6 is connected to a rear end portion of the exhaust pipe 4 via a first tapered pipe 53. The first tapered pipe 53 is connected to the downstream end portion of the exhaust pipe 4 in the expansion chamber S2, and increases in diameter as the position goes downstream (rearward). The catalyst unit 6 is connected to a rear end portion of the first tapered pipe 53.

The catalyst unit 6 is shaped like a cylinder, extends in the front-rear direction, and is larger in diameter than the exhaust pipe 4. The catalyst unit 6 is configured in such a manner that a cylindrical honeycomb portion for oxidizing or reducing prescribed components of exhaust gas is covered with an outer cylindrical portion. The catalyst unit 6 extends rearward and then penetrates through the first baffle plate 51. The catalyst unit 6 is thus supported by the first baffle plate 51. The downstream end of the catalyst unit 6 is open in the expansion chamber S1.

A tail pipe 55 for discharging exhaust gas that has flown through the expansion chambers S1-S3 to the outside is provided in the silencer 5. The tail pipe 55 is formed by bending a cylindrical pipe so as to assume an L shape in a plan view. More specifically, the tail pipe 55 penetrates through the second baffle plate 52 from the side of the expansion chamber S3, then goes into the right-hand expansion chamber S2, is then bent rearward in the chamber S2, and thereafter penetrates through the first baffle plate 51. The tail pipe 55 extends rearward in the expansion chamber S1, then penetrates through, at a rear-right position, portions, located on the two respective sides of the horizontal dividing plane and constituting the expansion chamber S1, of the upper half portion 5*a* and the lower half portion 5*b*, and is finally opened outside the silencer 5.

The upstream end of the tail pipe 55 is located in the rear of the communication hole 52*a*. The tail pipe 55 penetrates through the first baffle plate 51 at a position on the right of the communication pipe 51*a*. The communication pipe 51*a* is located at such a position as to overlap with the tail pipe 55 in a rear view.

Exhaust gas produced by combustion of the engine 2 and discharged from the exhaust port is introduced into the silencer 5 via the exhaust pipe 4. In the silencer 5, the exhaust gas is cleaned by the catalyst unit 6 and then discharged to the outside from the rear end of the tail pipe 55 via the expansion chambers S1-S3. More specifically, after passing through the catalyst unit 6, the exhaust gas is diffused in the expansion chamber S1. Subsequently, the exhaust gas is introduced into the expansion chamber S2 from the expansion chamber S1 via the communication pipe 51*a*, and then introduced into the expansion chamber S3 through the communication hole 52*a*. Finally, the exhaust goes into the tail pipe 55 from the expansion chamber S3 and is ejected to the outside from the tail pipe 55.

The exhaust gas is decreased in sound level gradually as it flows through the expansion chambers S1-S3. In particular, the capacities of the expansion chambers S1-S3 decrease gradually in this order, that is, in the order of passage of the exhaust gas, whereby the exhaust gas silencing effect is adjusted so as to vary stepwise.

In the embodiment, the internal space of the silencer 5 is partitioned into the three expansion chambers S1-S3 and the communication pipe 51*a* and the communication hole 52*a* (communication portions) are formed in the first baffle plate 51 and the second baffle plate 52, respectively. Thus, when exhaust gas flows from one expansion chamber into another expansion chamber through each communication portion, it does not hit the baffle plate 50 (first baffle plate 51 or second baffle plate 52) directly. That is, neither of the communication portions is opposed to the baffle plate 50. Vibration of the baffle plate 50 can therefore be suppressed.

Since the communication pipe 51*a* overlaps with the tail pipe 55 in a rear view (i.e., when viewed from the downstream side of the communication pipe 51*a*), exhaust gas hits the outer surface of the tail pipe 55 when it flows into the expansion chamber S2 from the expansion chamber S1 through the communication pipe 51*a*. Since the outer surface of the tail pipe 55 is a curved surface, the tail pipe 55 is not prone to be vibrated by the exhaust gas. Thus, causing exhaust gas to hit the curved external surface of the tail pipe 55 as a positive measure enhances the silencing effect further.

As described above, the catalyst unit 6 is connected to a downstream side of the exhaust pipe 4 and extends parallel with the second baffle plate 52 in the silencer 5. This structure makes it possible to give sufficient capacities to the respective expansion chambers S1-S3 while disposing the catalyst unit 6 in the silencer 5. Furthermore, the catalyst unit 6 is deviated rightward in the silencer 5, which makes it possible to install, utilizing the expansion chambers S1 and S2, the catalyst unit 6 which is relatively large among the components of the silencer 5, as well as to increase the degree of freedom of layout of the pipes for formation of an exhaust gas flowing passage in the silencer 5.

The catalyst unit 6 is attached to the first baffle plate 51 so as to penetrate through it and to be supported by it. This dispenses with a separate structure for supporting the catalyst unit 6 and thereby makes it possible to suppress weight increase of the silencer 5.

Since as described above the expansion chamber S1 is formed as a rear space of the silencer 5, a rear half portion of the silencer 5 where a relatively ample space can be secured easily can be used to form the expansion chamber S1 having a largest capacity. And the downstream end of the catalyst unit 6 is open in the expansion chamber S1, whereby exhaust gas that has just passed the catalyst unit 6 can be diffused in the expansion chamber S1. This makes it possible to attenuate the energy of exhaust gas effectively.

Figure 4:
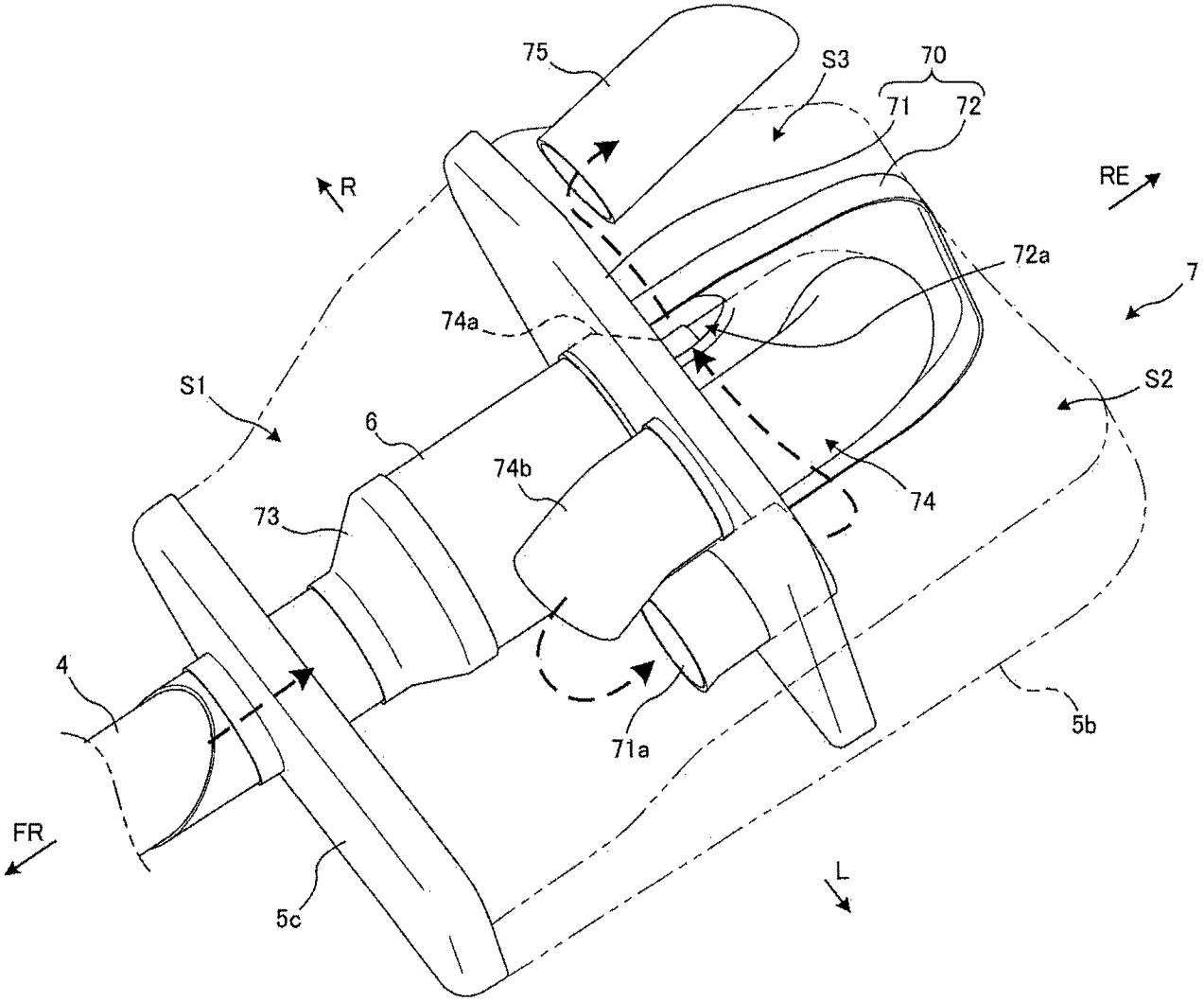
FIG. 4 is a perspective view of a silencer according to a first modification.
Figure 5:
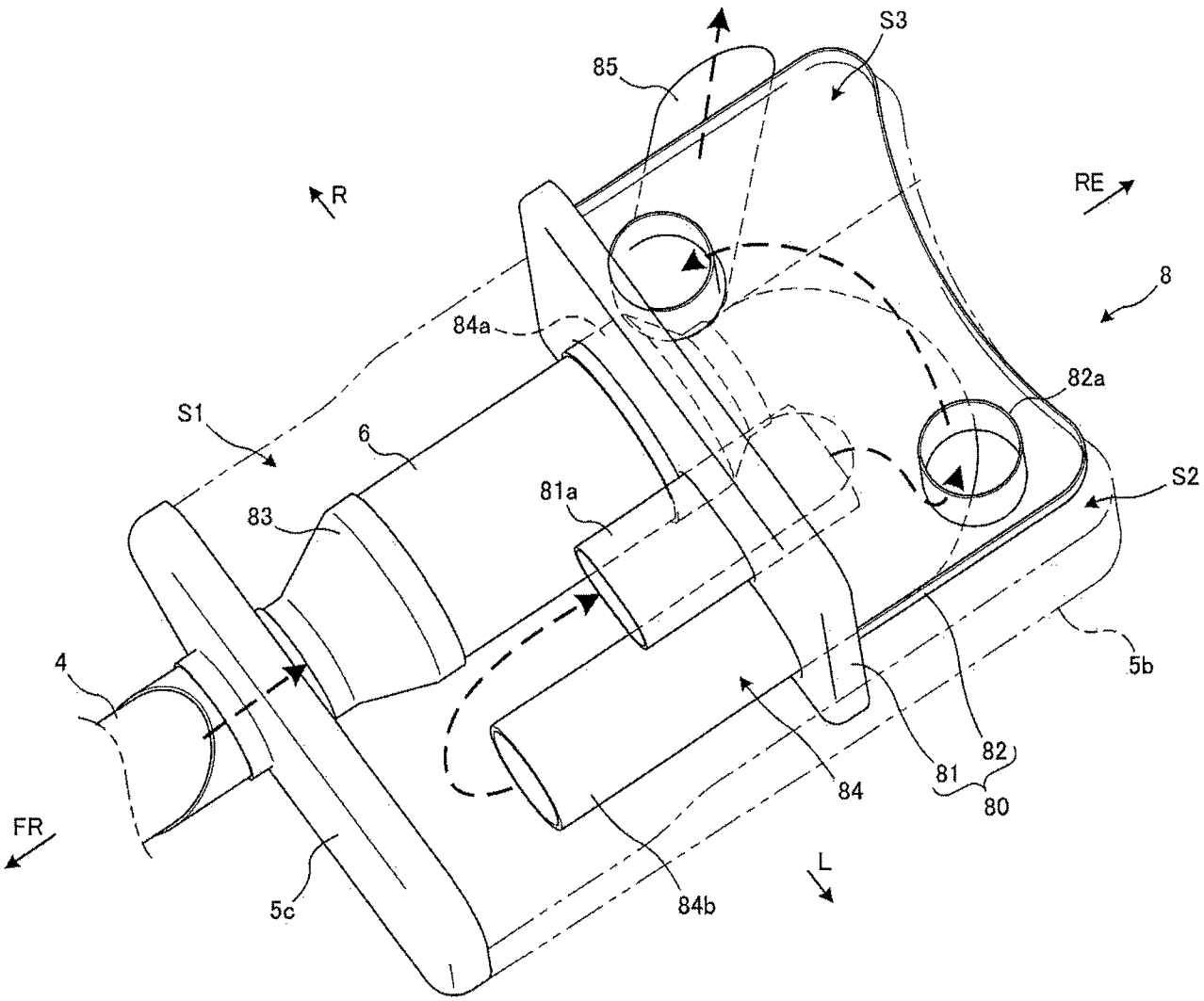
FIG. 5 is a perspective view of a silencer according to a second modification.

Next, engine exhaust devices according to modifications will be described with reference to FIGS. 4 and 5. FIGS. 4 and 5 are perspective view of a silencer 7 according to a first modification and a silencer 8 according to a second modification, respectively. The modifications are different from the embodiment in the layout of expansion chambers and the arrangement of pipes etc. in the silencer. Thus, the silencers 7 and 8 are the same in external shape as the silencer 5 shown in FIG. 3. Components of each modification having the same names as corresponding ones of the embodiment may be given the same reference symbols as the latter. And descriptions of components of each modification having the same ones in the embodiment will be omitted as appropriate.

In the first modification shown in FIG. 4, the internal space of the silencer 7 is divided into plural expansion chambers by a baffle plate 70. More specifically, the baffle plate 70 is composed of a first baffle plate 71 which partitions the internal space into a front half portion and a rear half portion and a second baffle plate 72 which partitions the rear half portion of the silencer 7 into two portions in the left-right direction. As such, the baffle plate 70 assumes a T shape in a plan view. The first baffle plate 71 is a flat, vertical partition wall that is located in the vicinity of the boundary between the front half portion and the rear half portion of the silencer 7, that is, approximately at the center of the silencer 7 in the front-rear direction. The second baffle plate 72 is a vertical partition wall that is the same in vertical length as the first baffle plate 71 and extends rearward from approximately the center of the first baffle plate 71 in the left-right direction. The second baffle plate 72 is a little deviated rightward in the silencer 7.

As described above, the internal space of the silencer 7 is partitioned into three expansion chambers S1, S2, and S3 by the baffle plate 70. The expansion chamber S1 is the internal space of the front half portion of the silencer 7, the expansion chamber S2 is the internal space of a left-hand portion of the rear half portion of the silencer 7, and the expansion chamber S3 is the internal space of a right-hand portion of the rear half portion of the silencer 7. The expansion chambers S1, S2, and S3 are formed so as to decrease in capacity in this order.

A communication pipe 71*a* is attached to the first baffle plate 71 at a bottom-left position so as to allow the expansion chambers S1 and S2 to communicate with each other. The communication pipe 71*a* is shaped like a cylinder and extends in the front-rear direction so as to penetrate through the first baffle plate 71 in its thickness direction. A communication hole 72*a* penetrates through the second baffle plate 72 in its thickness direction at a position that is close to its top-front corner and thereby allows the expansion chambers S2 and S3 to communicate with each other.

As described above, the exhaust pipe 4 penetrates through a right half portion of the front wall portion 5*c* and an upstream end portion of the catalyst unit 6 is connected to a rear end portion of the exhaust pipe 4 via a first tapered pipe 73. A baffle pipe 54 which is an exhaust gas passage in the silencer 7 is connected to a downstream end portion of the catalyst unit 6.

The first tapered pipe 73 is connected to the downstream end portion of the exhaust pipe 4 and the catalyst unit 6 is connected to a rear end portion of the first tapered pipe 73. The catalyst unit 6 is shaped like a cylinder, extends in the front-rear direction, and is larger in diameter than the exhaust pipe 4. The catalyst unit 6 is disposed in the upstream (front) expansion chamber S1 of the silencer 7.

This structure makes it possible to introduce exhaust gas having a relatively high temperature into the catalyst unit 6 because the catalyst unit 6 can be disposed at as upstream a position as possible. As a result, the temperature of the catalyst is increased to accelerate the cleaning of exhaust gas, that is, enhance the cleaning performance.

The baffle pipe 74 includes a second tapered pipe 74*a* which is connected to the downstream end portion of the catalyst unit 6 and a U-shaped pipe 74*b* which is connected to a downstream end portion of the second tapered pipe 74*a*. The second tapered pipe 74*a* decreases in diameter as the position goes downstream (rearward). An upstream end portion of the second tapered pipe 74*a* is attached to the first baffle plate 71 so as to penetrate through it. That is, the downstream end portion of the catalyst unit 6 is supported by the first baffle plate 71. A downstream end portion of the second tapered pipe 74*a* is located in the expansion chamber S3.

The U-shaped pipe 74*b* extends rearward in the expansion chamber S3 while being kept the same in diameter as the downstream end portion of the second tapered pipe 74*a*, and is then bent so as to penetrate through the second baffle plate 72 right to left. The U-shaped pipe 74*b* is inclined so as to extend up rightward in a front view and is bent so as to assume a U shape when viewed from a top-right position. The bent portion of the U-shaped pipe 74*b* is located around the position where the U-shaped pipe 74*b* crosses the second baffle plate 72.

After penetrating through the second baffle plate 52, the U-shaped pipe 54*b* extends forward in the expansion chamber S2 and then penetrates through the first baffle plate 71 at a position close to its top-left corner to go into the expansion chamber S1. A downstream end portion of the U-shaped pipe 74*b* is bent obliquely downward in the expansion chamber S1 so as to extend alongside the outer surface of the upper half portion 5*a* (see FIG. 2), and is opened in the expansion chamber S1.

A tail pipe 75 which extends rearward is attached to portions, located on the two respective sides of the horizontal dividing plane and constituting the expansion chamber S3, of the upper half portion 5*a* and the lower half portion 5*b*. A tip portion of the tail pipe 75 penetrates through the wall of the silencer 5 at a rear-right position and projects into the expansion chamber S3.

In the second modification shown in FIG. 5, the internal space of the silencer 8 is divided into plural expansion chambers by a baffle plate 80. More specifically, the baffle plate 80 is composed of a first baffle plate 81 which partitions the internal space into a front half portion and a rear half portion and a second baffle plate 82 which partitions the rear half portion of the silencer 8 into two portions in the top-bottom direction. As such, the baffle plate 80 assumes a T shape in a side view. The first baffle plate 81 is a flat, vertical partition wall that is located in the vicinity of the boundary between the front half portion and the rear half portion of the silencer 8, that is, approximately at the center of the silencer 8 in the front-rear direction. The second baffle plate 82 is a horizontal partition wall that is the same in left-right length as the first baffle plate 81 and extends rearward from a line that is a little above the center line (located in the horizontal dividing plane of the upper half portion 5*a* and the lower half portion 5*b*) of the first baffle plate 71 in the top-bottom direction.

As described above, the internal space of the silencer 8 is partitioned into three expansion chambers S1, S2, and S3 by the baffle plate 80. The expansion chamber S1 is the internal space of the front half portion of the silencer 8, the expansion chamber S2 is the internal space of a lower portion of the rear half portion of the silencer 8, and the expansion chamber S3 is the internal space of an upper portion of the rear half portion of the silencer 8. The expansion chambers S1, S2, and S3 are formed so as to decrease in capacity in this order.

A communication pipe 81*a* is attached to the first baffle plate 81 at a position that is a little on the left of the center so as to allow the expansion chambers S1 and S2 to communicate with each other. The communication pipe 81*a* is shaped like a cylinder and extends in the front-rear direction so as to penetrate through the first baffle plate 81 in its thickness direction. The communication pipe 81*a* has an elliptical cross section that is long in the left-right direction. A communication pipe 82*a* is attached to the second baffle plate 82 at a position that is close to its rear-left corner and penetrates through the second baffle plate 82 in its thickness direction so as to allow the expansion chambers S2 and S3 to communicate with each other.

As described above, the exhaust pipe 4 penetrates through a right half portion of the front wall portion 5*c* and an upstream end portion of the catalyst unit 6 is connected to a rear end portion of the exhaust pipe 4 via a first tapered pipe 83. A baffle pipe 84 which is an exhaust gas passage in the silencer 8 is connected to a downstream end portion of the catalyst unit 6. The first tapered pipe 83 is connected to the downstream end portion of the exhaust pipe 4 and the catalyst unit 6 is connected to a rear end portion of the first tapered pipe 83. The catalyst unit 6 is shaped like a cylinder, extends in the front-rear direction, and is larger in diameter than the exhaust pipe 4.

The baffle pipe 84 includes a second tapered pipe 84*a* which is connected to the downstream end portion of the catalyst unit 6 and a U-shaped pipe 84*b* which is connected to a downstream end portion of the second tapered pipe 84*a*, and assumes a U shaped in a top view. The second tapered pipe 74*a* decreases in diameter as the position goes downstream (rearward). An upstream end portion of the second tapered pipe 84*a* is attached to the first baffle plate 71 so as to penetrate through it. That is, the downstream end portion of the catalyst unit 6 is supported by the first baffle plate 81. A downstream end portion of the second tapered pipe 74*a* is located in the expansion chamber S2.

The U-shaped pipe 84*b* extends rearward in the expansion chamber S3 while being kept the same in diameter as the downstream end portion of the second tapered pipe 84*a*, and is then bent at a rear position in the expansion chamber S2 so as to extend forward and leftward. The U-shaped pipe 78*b* thereafter extends forward and penetrates through the first baffle plate 81. The tip of the U-shaped pipe 84*b* is is open in the expansion chamber S1.

A tail pipe 85 for discharging exhaust gas that has flown through the expansion chambers S1-S3 to the outside is attached to the silencer 5. The tail pipe 85 is formed by bending a cylindrical pipe so as to assume an L-shape in a rear view. More specifically, the tail pipe 85 extends downward from the expansion chamber S3 to the expansion chamber S2 penetrating through the second baffle plate 82, and is then bent rearward and rightward in the expansion chamber S2. The tail pipe 85 penetrates, at a rear-right position, through portions, located on the two respective sides of the horizontal dividing plane and constituting the expansion chamber S2, of the upper half portion 5*a* and the lower half portion 5*b*, and is finally opened outside the silencer 5.

Also in the modifications shown in FIGS. 4 and 5, exhaust gas produced by combustion of the engine 2 and discharged from the exhaust port is introduced into the silencer 7 or 8 via the exhaust pipe 4. In the silencer 7, or 8, the exhaust gas is cleaned by the catalyst unit 6 and then discharged to the outside from the rear end of the tail pipe 75 or 85 via baffle pipe 74 or 84 and the expansion chambers S1-S3. Also in the first and second modifications, the internal space of the silencer 7 or 8 is partitioned into the expansion chambers S1-S3 by the T-shaped baffle plate 70 or 80. In particular, in the first and second modifications, the U-shaped baffle pipe 74 or 84 is connected to the downstream end portion of the catalyst unit 6 and the downstream end of the baffle pipe 74 or 84 is open in the expansion chamber S1. Thus, although the expansion chamber S1 having a largest capacity is disposed as a front portion of the silencer 7 or 8, exhaust gas that has passed through the catalyst unit 6 can be diffused first in the expansion chamber S1, whereby the silencing effect is enhanced.

Although the above-described embodiment and its modifications are directed to the case of using the parallel two-cylinder engine 2, the invention is not limited to that case. For example, the engine 2 may be of a single cylinder type or a type having three or more cylinders. And the arrangement of the cylinders is not limited to the parallel arrangement and may be changed as appropriate.

Although in the above embodiment and its modifications the vehicle body frame 10 is a diamond-shaped frame, the invention is not limited to that case. For example, the vehicle body frame 10 may be a twin-spar frame.

Although in the above embodiment and its modifications the internal space of the silencer 5, 7, or 8 is partitioned into two portions in the front-rear direction by the first baffle plate 51, 71, or 81 and one of the divisional internal spaces is partitioned into two portions in the left-right direction or the top-bottom direction by the second baffle plate 52, 72, or 82, the invention is not limited to this case. The internal space of the silencer 5, 7, or 8 may be partitioned into more than three portions. Furthermore, the partitioning direction is not limited to the front-rear direction, the left-right direction, or the top-bottom direction, and may be changed as appropriate.

Although in the above embodiment and its modifications the first baffle plate 51, 71, or 81 and the second baffle plate 52, 72, or 82 are formed so as to be perpendicular to each other, the invention is not limited to this case. The angle formed by the first baffle plate 51, 71, or 81 and the second baffle plate 52, 72, or 82 may be changed to a prescribed, appropriate angle.

Although in the above embodiment and its modifications the capacities of the expansion chambers S1-S3 decrease gradually from the upstream side, the invention is not limited to this case. It suffices that the expansion chamber S1 where exhaust gas is diffused first have a largest capacity; whichever of the expansion chambers S2 and S3 may be larger in capacity than the other.

Although in the above embodiment and its modifications the communication pipe(s) (and the communication hole) are used as the communication portions that penetrate through the baffle plate 50, 70, or 80, the invention is not limited to the related structures of the embodiment and its modifications. Each communication hole may be replaced by a communication pipe, and each communication pipe may be replaced by a communication hole.

Although in the above embodiment and its modifications a communication portion(s) is formed in both of the first baffle plate 51, 71, or 81 and the second baffle plate 52, 72, or 82, the invention is not limited to this case. Communication portions may be formed in only one of the first baffle plate 51, 71, or 81 and the second baffle plate 52, 72, or 82.

Although the embodiment and its modifications have been described above, the embodiment and a modification(s) may be combined with each other partially or in their entireties to constitute another embodiment of the invention.

The invention is not limited to the above embodiment and its modifications but may be changed, modified, or subjected to replacement of a constituent element(s) in various manners without departing from the spirit and scope of the technical concept of the invention. Furthermore, if it becomes possible to implement the technical concept of the invention by another method due to a technical advancement or using another, derivative technique, the invention may be practiced using that method. As such, the claims should cover all embodiments that can be included in the scope of the technical concept of the invention.

Providing the above-described advantage that the silencing effect can be enhanced while the degree of freedom of layout of expansion chambers and that of arrangement of components in a silencer are increased, the invention is useful when applied to, in particular, engine exhaust devices that can be applied to motorcycles.

What is claimed is:

1. An engine exhaust device comprising an exhaust pipe attached to a vehicle engine and a silencer connected to a downstream side of the exhaust pipe, wherein:

the silencer comprises:

a first partition wall which partitions an internal space of the silencer into at least two spaces in a first direction; and a second partition wall which partitions one of the at least two spaces into two spaces in a second direction that crosses the first direction;

another one of the at least two spaces is larger in capacity than each of the two spaces defined by the second partition wall; and a downstream end of the exhaust pipe is open in the another one of the at least two spaces;

wherein the engine exhaust device further comprises a catalyst unit which cleans the exhaust gas discharged from the engine;

the catalyst unit is connected to a downstream side of the exhaust pipe and is disposed so as to extend parallel with the second partition wall;

the another one of the at least two spaces is located in a rear part of the silencer, and a downstream end of the catalyst unit is open in the another one of the at least two spaces;

the silencer is box shaped and disposed in the rear of an oil pan and below the swing arm;

the rear part of the silencer is located below the swing arm; and in a side view, the height of the silencer increases as the position goes rearward.

2. The engine exhaust device according to claim 1, wherein:

the second partition wall partitions the one of the at least two spaces in a left-right direction; and the catalyst unit is deviated to one side in the left-right direction.

* * * * *